US005980033A

United States Patent [19]

Nakamura

[11] Patent Number: 5,980,033

[45] Date of Patent: Nov. 9, 1999

[54] PACKAGING AND METHOD OF STORING INK JET PRINTING HEAD

[75] Inventor: Fumiharu Nakamura, Yokohama, Japan

[73] Assignee: Canon Kabushiki Kaisha, Tokyo, Japan

[21] Appl. No.: 08/912,649

[22] Filed: Aug. 18, 1997

Related U.S. Application Data

[63] Continuation of application No. 08/263,677, Jun. 22, 1994, abandoned.

[30] Foreign Application Priority Data

Jun. 28, 1993 [JP] Japan ..... 5-157054

[51] Int. Cl.[6] ..... B41J 2/175

[52] U.S. Cl. ..... 347/87

[58] Field of Search ..... 347/22, 23, 28, 347/85–87, 108; 206/213.1, 328

[56] References Cited

U.S. PATENT DOCUMENTS

| | | | |
|---|---|---|---|
| 4,148,041 | 4/1979 | Rosenstock | 347/28 |
| 4,286,272 | 8/1981 | Schwob | 347/74 |
| 4,947,187 | 8/1990 | Iwagami | 347/28 |
| 5,244,087 | 9/1993 | Hikake et al. | 347/87 |
| 5,364,045 | 11/1994 | Clayton et al. | 206/213.1 |

FOREIGN PATENT DOCUMENTS

| | | | |
|---|---|---|---|
| 535686 | 4/1993 | European Pat. Off. | 347/23 |
| 3726671 | 7/1988 | Germany | 347/28 |
| 109666 | 8/1980 | Japan | 347/28 |
| 60-204366 | 10/1985 | Japan . | |
| 61-025844 | 2/1986 | Japan . | |
| 61-093264 | 6/1986 | Japan . | |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

In a packaging for and method of storing a detachable, exchangeable type ink jet printing head to be mounted on ink jet printing device, the ink jet printing head is cleaned and vacuum dried and then contained in a containing member without ink charging until the time of its use, in order to prevent initial printing failure caused by printing ink adhesion, ink evaporation and leakage.

6 Claims, 2 Drawing Sheets

PACKAGING AND METHOD OF STORING INK JET PRINTING HEAD

This application is a continuation of application Ser. No. 08/263,677 filed Jun. 22, 1994 now abandoned.

BACKGROUND OF THE INVENTION

1. Field of the Invention

The present invention relates to packaging and a method of storing a detachable and exchangeable ink jet printing head which is to be mounted on an ink jet printing device.

2. Description of the Prior Art

An ink jet printing device is a device designed to print out characters and other marks on a paper or on other recording media by ejecting liquid ink from a printing head. The types of the printing head primarily include a permanent type, in which the printing head is permanently fixed to the printing device, and a detachable type, in which the printing head is easily detachable for exchange by users.

As for the permanent type printing head, an ink jet printing head is already mounted on the printing device upon the shipment of the printing device. Therefore, the user of the printing device is exempted from exchanging the printing head except in the case of a printing head malfunction, upon which sufficiently good printing is hindered, then the exchange of the printing head by calling a serviceman becomes inevitable.

For the permanent type printing head, normally, printing ink or preservation liquid is filled in the printing head and a cap is applied on the outlet of the printing head for transportation and storage in order to prevent the leakage of the ink.

On the other hand, as to the detachable type printing head, a printing head and an ink reservoir are integrally constructed, where the integral printing head and the ink reservoir are easily detachable when the ink is exhausted, or each of the printing head and the ink reservoir can be separately detachable by the user.

As for the detachable ones in the case of the former, in which the printing head and the ink reservoir are integral, then, for instance, as disclosed in Japanese laid-open Patent Publication No. 60-204366, the internal pressure of the containing package is reduced and the meniscus of ink located at the nozzle is moved to the inside of the reservoir in order to eliminate the disadvantage of ink leakage or ink adhesion caused by evaporation of ink from the nozzle upon transportation and storage.

Also, regarding the latter of the detachable type printing head mentioned above, each of the printing head and the ink reservoir is separately packaged. In this case, ink or a sort of liquid called "clear ink" which is the liquid content excluding ink coloring ingredients, is charged and then sealed or capped to prevent the leakage of ink from the printing head nozzle. As mentioned above, the detachable type printing head charged with ink or clear ink brings about the evaporation of charged ink with the elapse of time when they are stored. When evaporated, it brings about the adhesion of ink coloring ingredients on the ink discharge driving element such as an electro-thermal conversion unit. In order to avoid such a problem, as disclosed in Japanese laid-open Patent Publication No. 61-25844, the package itself is charged and saturated with the same substance as that of the ink evaporation component, or as disclosed in Japanese laid-open utility model Publication No. 61-93264, the package itself is made of a material having a low gas permeability.

However, it is extremely difficult to prevent ink evaporation completely and it is also extremely difficult to actually avoid the adhesion of the ink coloring ingredient at the inside of the printing nozzle. As it is uncertain to conduct good printing immediately after the installation of a printing head with adhered ink coloring ingredients at the inside of the nozzle, normally, a certain recovery operation is conducted in order to recover the ink discharge condition. This recovery operation inevitably require much consumption of ink to meet the requirement for a satisfactory level of recovery for a most deteriorated nozzle discharge.

Also, on the printing head, some electrodes are provided to receive signals from the printing device, and the evaporation of ink within the package causes oxidation on the electrode surface which results in an undesirable situation.

As mentioned already, the sealing materials such as seals, caps and the like provided on the discharging portion of the printing head, have to be removed by the users for mounting on the printing device and, upon such removal, it is very likely to stain the user's fingers with the ink which comes out from the printing head and is scattered therefrom.

SUMMARY OF THE INVENTION

The purpose of the present invention is to solve the above-mentioned problems, and to provide a method for storing an ink jet printing head that provides the ability to eliminate the initial printing defects caused by ink adhesion. Also, this invention eliminates the waste of ink for a recovery operation needed right after printing head exchange, and also eliminates the use of sealing materials to prevent the ink evaporation and leakage as well as the scattering of ink.

According to the present invention, the method for storing an ink jet printing head of a detachable type to be mounted on an ink jet printing device is to store the printing head without any liquid or solid inside the space to be charged with printing ink, until the time of mounting ink jet printing head on the printing device.

Also, this invention provides a storing method for the ink jet printing head by enclosing the ink jet printing head in a packaging without any charged liquid or solid in the closed space within the packaging.

Preferably, according to this invention, the closed space within the packaging is filled with an inert gas by the ratio substantially of not less than 80%.

Moreover, according to this invention, the possibility of bringing about adherence of printing ink caused by ink evaporation is eliminated by maintaining the ink jet printing head without any printing ink or preservation liquid inside the ink jet printing head for the storing period until the time of mounting the ink jet printing head on the printing device by the user. Also, according to this invention, a stable printing capability is assured only by conducting a slight recovery operation immediately after the mounting on the printing device. Moreover, the thermal conversion efficiency of the electrothermal conversion unit in the nozzle can be maintained above a preferable level.

This invention also eliminates the need of conventional sealing materials for preventing evaporation and ink leakage. Moreover, this invention eliminates the scattering of ink or preservation liquid in the case of mounting on the printing device since no liquid is charged in the ink jet printing head.

This invention also enables the printing head to maintain the initial printing quality in a more stable manner by filling the closed space within the packaging with an inert gas by the ratio substantially of not less than 80%.

DETAILED DESCRIPTION OF THE PREFERRED EMBODIMENT

Figure 1:
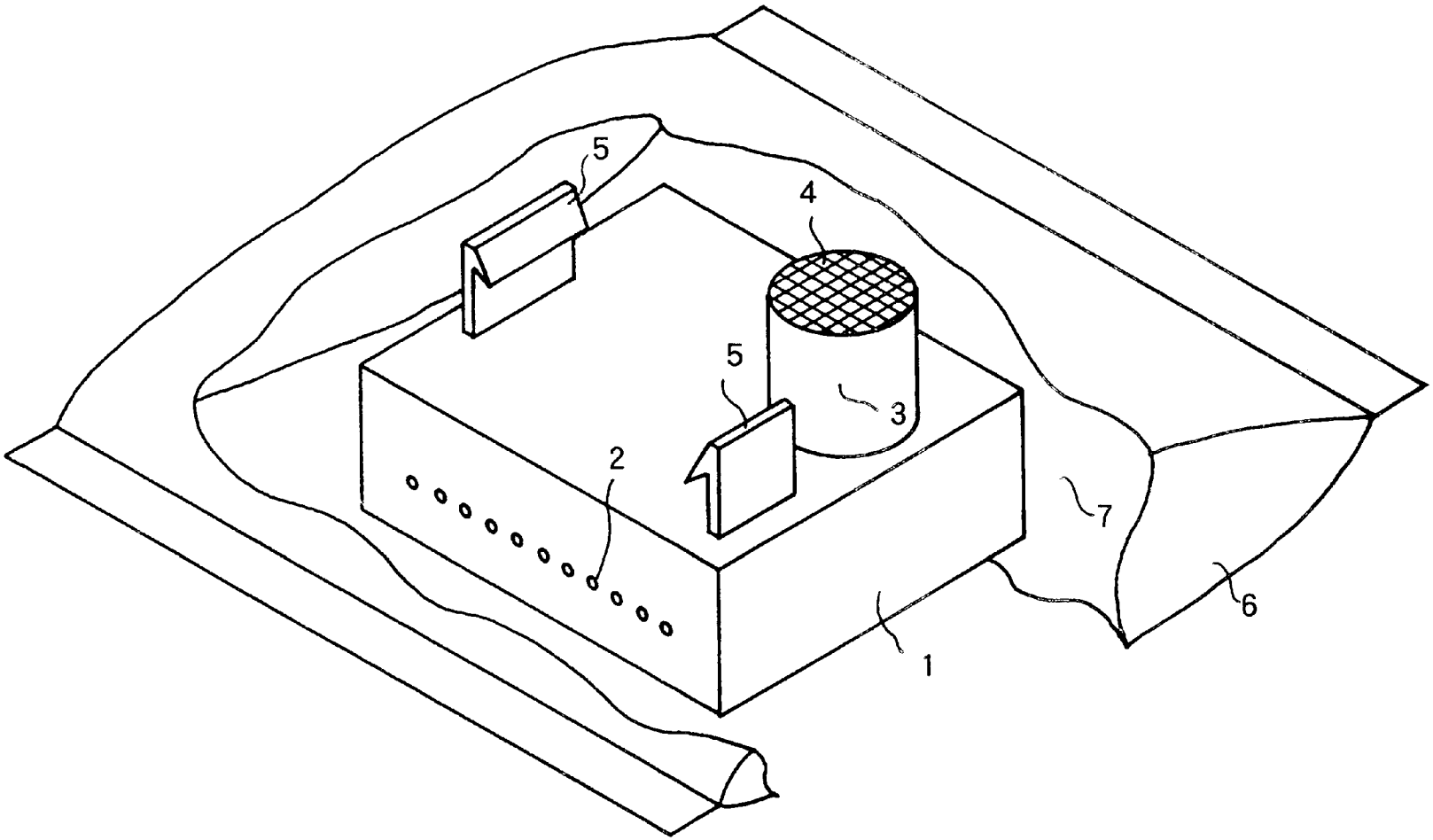
FIG. 1 is a perspective view of an embodiment according to this invention.

FIG. 1 is a perspective view showing an embodiment according to this invention, wherein an outer view of the detachable type ink jet printing head to be exchanged by the user and to be mounted on an ink jet printing device is indicated.

In FIG. 1, reference numeral 1 is a detachable type ink jet printing head, reference numeral 2 is an ink discharge outlet, reference numeral 3 is an ink supply inlet for supplying printing ink from the ink reservoir (not shown), reference numeral 4 is a filter for removing the dust of from the ink reservoir, reference numeral 5 is a panol for connection to the ink reservoir, reference numeral 6 is a packaging for enclosing ink jet printing head 1, and reference numeral 7 is a gas charged into the closed space enclosed within said packaging 6.

During the period while said ink jet printing head 1 is not yet mounted on the printing device not shown in the drawing, the ink jet printing head is transported and stored under the condition that any liquid-like printing ink or preservation liquid or any solid to be charged for printing is not charged into both the inside of the printing head and the enclosed space packaged by the hermetically sealed material.

Also, at this time, the printing head is transported and stored under the condition that it is merely packaged by the packaging 6, and with no sealing members like seals, caps and the like attached to ink discharge outlet 2 and ink supply inlet 3.

Figure 2:
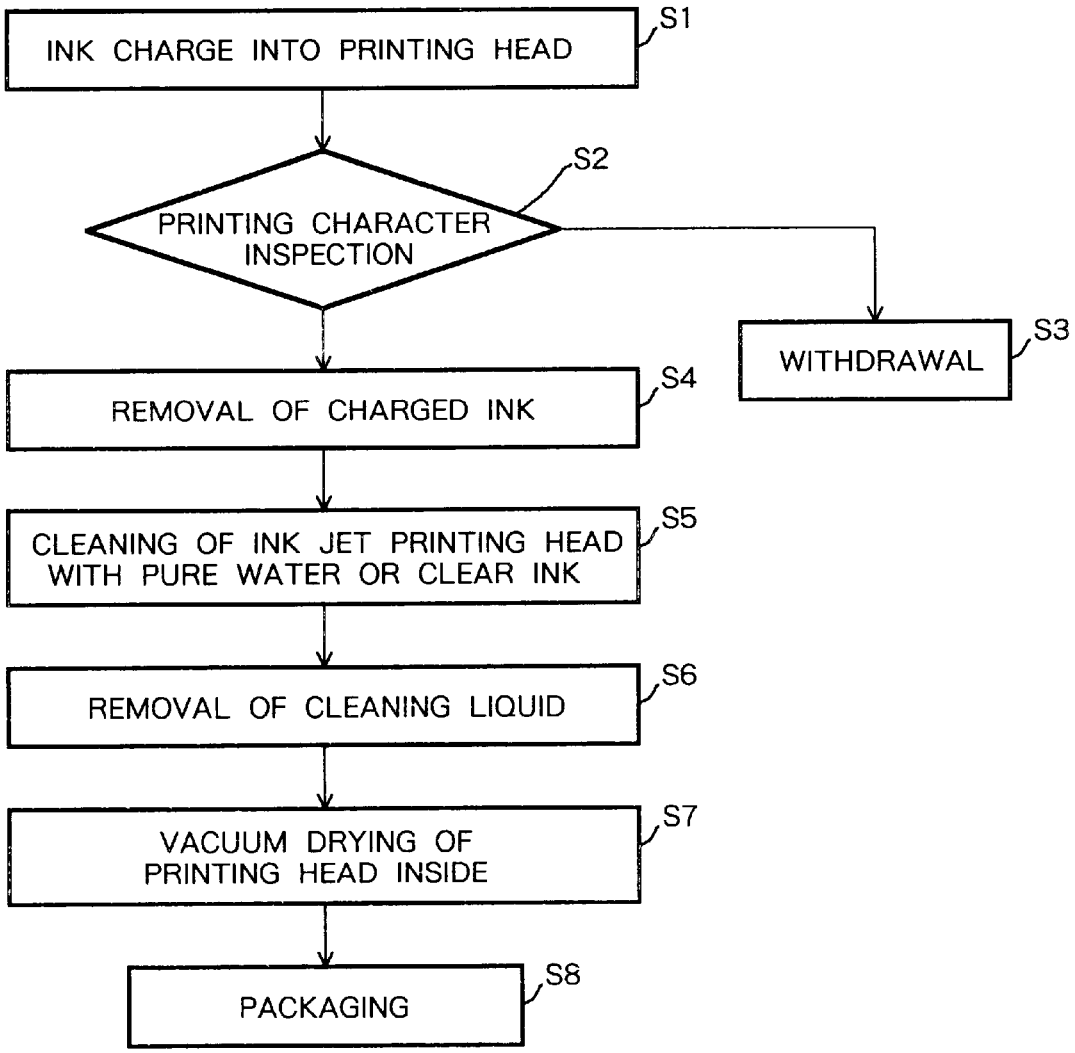
FIG. 2 is a flow chart for illustrating a method of storing the ink jet printing head according to the present invention.

Through the process shown in FIG. 2, the ink jet printing head is packaged, transported and stored. An explanation is made as mentioned hereunder referring to FIG. 2.

The printing character inspection of the produced ink jet printing head is made, on all products, to check for normal ink discharge. The printing head offered for printing character inspection is filled with printing ink as shown in Step 1 (S1), then brought to a printing character inspecting device as shown in Step 2 (S2) to execute printing character inspection. The printing head, of which any defect in ink discharge has been detected, is withdrawn in Step 3 (S3).

On the other hand, the ink in the printing head, of which no defect in ink discharge has been detected, is removed by applying a suction device such as a vacuum pump and the like from the nozzle side of the printing head as shown in step 4 (S4). In this embodiment, the removal of printing ink was conducted by applying a suction pump under the condition of 180 torr, 10 liter/min. for 3 and up to 5 seconds. Then, the inside of the printing head was cleaned by using pure water or clear ink as shown in Step 5 (S5). This cleaning is to remove the coloring ingredients contained in the ink which is still remaining within the already sucked printing head. (Especially, when the coloring ingredient remains around the area of the electro-thermal conversion unit in the nozzle, and dries, the adherence the coloring ingredient takes place and scorching upon printing or defective printing is likely to happen.) Cleaning of the printing head was conducted by applying a continuous flow of pure water or clear ink through the printing head. When bubble cleaning, that is to say, cleaning by mixing bubbles into the cleaning liquid, is applied, it will result in the increase of the cleaning effect and the saving of the cleaning time. Cleaning was conducted by applying the suction pump mentioned in Step 4 and by applying the flow of the cleaning liquid through the printing head under the condition of 180 torr, 10 liter/min. for 10 seconds. In the next step 6 (S6), cleaning liquid was removed from the inside of the printing head under the condition of 180 torr, 10 liter/min, for 3 and up to 5 seconds. This step is incorporated because of its effectiveness to shorten the time of the vacuum drying in the next step.

Step 7 (S7) is a process for removing the remaining cleaning liquid in the printing head by applying vacuum drying. By removing the cleaning liquid sufficiently, the unevenness of the printing quality among nozzle of to the printing head can be eliminated. By conducting vacuum drying, it becomes possible to maintain the printing quality of the head satisfactorily right after its mounting on the printing device even after a long period of transportation and storage of the printing head.

The vacuum drying is conducted for about one hour by maintaining the inside of the vacuum drying device under the temperature from 45 degrees C. up to 55 degrees C. and under the pressure of approx. 10 torr. The pressure reducing speed does not affect the drying efficiency.

At Step 8 (S8), the printing head, on which vacuum drying has been completed, is packaged as shown in FIG. 1.

The packaging material for the printing head, on which the above-mentioned treatment has been completed, does not require a particular material for the less permeability of gas as there is not any residue of ink to give defective influence on the electro-thermal conversion unit and not any evaporating substance to oxidize the electrode.

According to the present invention, with the above-mentioned steps applied prior to the transportation and storing, ink adhesion in the printing head caused by the the evaportation and drying of ink is avoided, and generation of the initial printing defect is prevented to ensure stable printing quality. Moreover, the condition of a recovery operation for the stable initial printing quality can be lowered, resulting in less consumption of waste ink. Moreover, according to the present invention, the conventional sealing materials such as seals and caps needed for enclosing the ink jet printing head 1 in which the ink or the preservation liquid is contained can be eliminated, resulting in the reduction of cost, and yet with no scattering of ink.

When filling the closed space enclosed within the sealing packaging 6 with an inert gas 7 by the ratio substantially of not less than 80%, it is possible to maintain the initial performance of the ink jet printing head 1 in good condition for a longer period of time.

As mentioned above, the present invention provides a method for transporting and storing an ink jet printing head without any liquid and solid in the closed space, which is to be filled with printing ink upon use. As a consequence, there are provided such merits that the initial printing defect caused by the adhesion of printing ink is prevented by this invention, and the sealing material needed for preventing ink evaporation and ink leakage is eliminated, and in addition the scattering of the ink is prevented.

What is claimed is:

1. A method for storing an ink jet printing head which is detachable and exchangeable to both an ink jet printing device and an ink reservoir storing ink for discharge, said method comprising the steps of:

providing (i) an ink jet printing head as a single member separated from an ink reservoir and (ii) a containing member for containing the ink jet printing head as a single member;

preprocessing the ink jet printing head by filling the ink jet printing head with printing ink, discharging the ink from the ink jet printing head, inspecting a condition of discharged ink, removing the filled ink from the ink jet printing head, cleaning inside portions of the ink jet printing head with a cleaning liquid, removing the cleaning liquid, and vacuum drying all portions of the printing head; and packaging and storing the ink jet printing head as the single member within the containing member under a condition that no liquid is stored in any area including a space within the ink jet printing head for receiving printing ink during use of the printing head.

2. The method according to claim 1, wherein said step of packaging and storing the ink jet printing head as the single member within the containing member comprises filling the containing member with an inert gas to a predetermined amount.

3. The method according to claim 2, wherein the containing member is filled with inert gas to substantially not less than eighty percent by volume of the containing member.

4. A method for packaging an ink jet printing head which is detachable and exchangeable to both an ink jet printing device and an ink reservoir storing ink for discharge, the method comprising the steps of:

providing (i) an ink jet printing head as a single member separated from an ink reservoir and (ii) a containing member for containing the ink jet printing head as a single member;

preprocessing the ink jet printing head by filling the ink jet printing head with printing ink, discharging the ink from the ink jet printing head, inspecting a condition of discharged ink, removing the filled ink from the ink jet printing head, cleaning inside portions of the ink jet printing head with a cleaning liquid, removing the cleaning liquid, and vacuum drying all portions of the printing head; and packaging and storing the ink jet printing head as the single member within the containing member under a condition that no liquid is stored in any area including a space within the ink jet printing head for receiving printing ink during use of the printing head.

5. The method according to claim 4, wherein said step of packaging and storing the ink jet printing head as the single member within the containing member comprises filling the containing member with an inert gas to a predetermined amount.

6. The method according to claim 5, wherein the containing member is filled with inert gas to substantially not less than eighty percent by volume of the containing member.

* * * * *

UNITED STATES PATENT AND TRADEMARK OFFICE

CERTIFICATE OF CORRECTION

PATENT NO. : 5,980,033

DATED : November 9, 1999

INVENTOR(S) : NAKAMURA

It is certified that error appears in the above-identified patent and that said Letters Patent is hereby corrected as shown below:

COLUMN 1:
Line 66, "utility model" should read --Utility Model--.

COLUMN 2:
Line 9, "require" should read --requires--.

COLUMN 3:
Line 19, "of from" should read --from--.
Line 20, "panol" should read --pawl--.

COLUMN 4:
Line 37, "the the" should read --the--.
Line 38, "evaportation" should read --evaporation--.

Signed and Sealed this

Seventh Day of November, 2000

*Attest:*

Q. TODD DICKINSON

*Attesting Officer*

*Director of Patents and Trademarks*